US007134422B2

(12) United States Patent
Yanagibashi et al.

(10) Patent No.: US 7,134,422 B2
(45) Date of Patent: Nov. 14, 2006

(54) AIR INTAKE STRUCTURE FOR A VEHICLE, AND VEHICLE INCLUDING SAME

(75) Inventors: Yoshitaka Yanagibashi, Saitama (JP); Koichi Kobayashi, Saitama (JP); Junji Higashiyama, Saitama (JP); Tetsuya Kudo, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 121 days.

(21) Appl. No.: 10/945,256

(22) Filed: Sep. 20, 2004

(65) Prior Publication Data

US 2005/0066936 A1 Mar. 31, 2005

(30) Foreign Application Priority Data

Sep. 30, 2003 (JP) ..... 2003-341058

(51) Int. Cl.
*F02D 9/08* (2006.01)

(52) U.S. Cl. ..... 123/336; 123/337

(58) Field of Classification Search ..... 123/308, 123/336, 337, 188.14
See application file for complete search history.

(56) References Cited

U.S. PATENT DOCUMENTS 4,413,598 A * 11/1983 Tsutsumi ..... 123/306
5,311,848 A * 5/1994 Isaka et al. ..... 123/188.14
5,671,712 A * 9/1997 Uchida ..... 123/308
5,845,677 A * 12/1998 Kim ..... 137/595
2001/0035154 A1* 11/2001 Yamaguchi et al. ..... 123/308
2004/0144359 A1* 7/2004 Iwata et al. ..... 123/336
2004/0244767 A1* 12/2004 Nishii et al. ..... 123/308

FOREIGN PATENT DOCUMENTS

JP UM-A-63-60041 4/1988

* cited by examiner

*Primary Examiner*—Erick R Solis
(74) *Attorney, Agent, or Firm*—Carrier, Blackman & Associates, P.C.; William D. Blackman; Joseph P. Carrier

(57) ABSTRACT

In an air intake assembly, a portion of an inner peripheral wall of an intake funnel pipe is provided as a pivotally movable blocking body, so that when unthrottled, an inner wall surface of the blocking body is flush with the inner peripheral wall of the funnel pipe. The blocking body has a substantially trianglular outline shape, the apex of which is positioned on top when viewed along the axis of the support shaft. The support shaft is positioned at the apex of the blocking body, and allows pivotal movement of the blocking body, on the downstream side thereof, to allow adjustment of the rate of air flow through the funnel pipe. The blocking body within the funnel pipe of an air intake assembly allows a smooth flow of air therepast when actuated to throttle the air intake channel, and does not obstruct the air intake channel when inactive.

19 Claims, 10 Drawing Sheets

AIR INTAKE STRUCTURE FOR A VEHICLE, AND VEHICLE INCLUDING SAME

CROSS-REFERENCE TO RELATED APPLICATIONS

The present invention claims priority under 35 USC 119 based on Japanese patent application No. 2003-341058, filed Sep. 30, 2003.

BACKGROUND OF THE INVENTION

1. Field of the Invention

The present invention relates to vehicle intake systems. More particularly, the present invention relates to an air-intake routing and control structure for a motorcycle or similar vehicle.

2. Description of the Background Art

In the related art, an air-intake structure is known that includes an intake air control mechanism, for adjusting the amount of intake air passing through the air-intake channel connected to an engine. The adjustment is achieved using by a throttle valve, and an intake air flow control valve provided separately from the throttle valve. The known intake air flow control valve is positioned between a main body of the intake air control mechanism on which the throttle valve is provided, and an intake air-introducing member, such as a funnel pipe which constitutes part of the air-intake channel. The known intake air control valve varies the cross-sectional area of the air-intake channel by allowing part of the intake air control valve to project into the air-intake channel. An intake air control mechanism of this type is disclosed in Japanese Patent document JP-UM-A-63-60041.

However, as disclosed in the arrangement described in Japanese Patent document JP-UM-A-63-60041, when the distance between the engine and the intake air-introducing member is small, it is difficult to provide a main body of the intake air control mechanism within this small space. Further, it is difficult to obtain an installation space for installing the main body having the throttle valve provided thereon and the intake air control valve together in the intake air control mechanism within the available space. Therefore, satisfactory arrangement of the intake air control valve is difficult to achieve.

SUMMARY OF THE INVENTION

Throughout the present specification, the term "upstream side" designates a position upstream with respect to the direction of the airflow, and the term "downstream side" designates a position downstream with respect to the direction of the airflow, with respect to an air-intake component. In order to solve the above-described problem, the present invention is directed to an intake air control mechanism for connecting to an engine provided in a vehicle. The intake air control mechanism according to an embodiment of the present invention includes an air-intake channel, and controls the amount of intake air provided to the engine using a throttle valve positioned within an expanded portion, or blocking body chamber, formed in the air-intake channel. In addition, the expanded portion is provided in an intake air-introducing member, or funnel, provided within the intake air control mechanism separately from the main body having the throttle valve.

A blocking body for varying the cross-sectional area of the air-intake channel is disposed in the expanded portion, or blocking body chamber. The blocking body chamber opens on the air-intake side of the intake air-introducing member, or funnel. The blocking body is driven by an actuator.

A support shaft for pivotally supporting the blocking body is disposed on the upstream side of the blocking body. The support shaft is installed in the vicinity of the end of the opening of the intake air-introducing member. The support shaft is installed on the outside of the air-intake channel.

Another embodiment of the present invention is directed to a vehicle's air-intake structure including an intake air control mechanism having a throttle valve connected to an engine provided on a vehicle, and an intake air-introducing member which is part of an air-intake channel of the intake air control mechanism. The vehicle's air-intake structure includes a blocking body for varying the cross-sectional area of the air-intake channel. The blocking body defines part of the inner peripheral wall of the intake air-introducing member. The inner peripheral surface of the blocking body that faces the inner portion of the intake air-introducing member is formed along the air-intake channel.

The blocking body defines the end of the opening of the intake air-introducing member. The support shaft for pivotally supporting the blocking body is disposed on the upstream side of the blocking body. The support shaft is installed in the vicinity of the end of the opening of the intake air-introducing member. The blocking body is positioned outside the air-intake channel when the air-intake channel is unthrottled.

According to one aspect of the invention, since the blocking body for varying the cross-sectional area of the air-intake channel is disposed in the expanded portion of the intake air control mechanism, the expanded portion can be used effectively for arranging the blocking body therewithin, and hence a space for arranging the blocking body can easily be ensured. In addition, since the expanded portion may be provided at a position apart from the engine, the blocking body may be disposed on the upstream side of, and apart from, the main body which immediately precedes the engine cylinders and has its own throttle valve.

According to another aspect of the invention, since the expanded portion is provided in the intake air-introducing member and is formed separately from the main body which immediately precedes the engine cylinders and has its own throttle valve, the expanded portion can be provided easily and the separately provided intake air-introducing member can be utilized effectively for arranging the blocking body.

According to another aspect of the invention, by arranging the blocking body in the air cleaner box, opening on the air-intake side of the intake air-introducing member, the required space for arranging the support shaft there is obtained. Also, the amount of operating sound produced by the movable blocking body is reduced by the air cleaner box, and the movable portion can is protected by splashing mud.

According to another aspect of the invention, by disposing the blocking body apart from the engine, the actuator for driving the blocking body can be installed apart from the engine as well. Therefore, arrangement of members such as cable extending from the actuator is easily accomplished.

According to another aspect of the invention, since the support shaft is disposed upstream of the blocking body at a distance from the engine, a space with respect to the engine is easily secured. Since the support shaft for pivotally supporting the blocking body is disposed on the upstream side of the blocking body, the blocking body can be throttled at a gentle angle with respect to the flow of intake air, and consequently, intake air can flow smoothly.

According to another aspect of the invention, since the support shaft is installed in the vicinity of the end of the opening of the intake air-introducing member, it is disposed largely apart from the engine, and hence the space for arranging the support shaft is easily secured. In addition, since the support shaft is installed in the vicinity of the end of the opening of the intake air-introducing member, disturbance of intake air in the vicinity of the support shaft is reduced.

According to another aspect of the invention, sine the support shaft is disposed outside the air-intake channel, the support shaft is prevented from disturbing the flow of intake air.

According to another aspect of the invention, since the inner wall surface of the blocking body facing the intake air-introducing member is formed along the air-intake channel, intake air flows smoothly along the wall surface of the air-intake channel. In addition, since the blocking body defines the end of the opening of the intake air-introducing member, the flow of intake air is not easily disturbed when throttling the blocking body. Also, since it is not necessary to provide a notch to accommodate the blocking body range of motion, the air-intake channel is formed to be smooth.

According to another aspect of the invention, since the blocking body is positioned outside the air-intake channel when the air-intake channel is unthrottled, intake air flows smoothly along the wall surface of the air-intake channel.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF THE INVENTION

Figure 1:
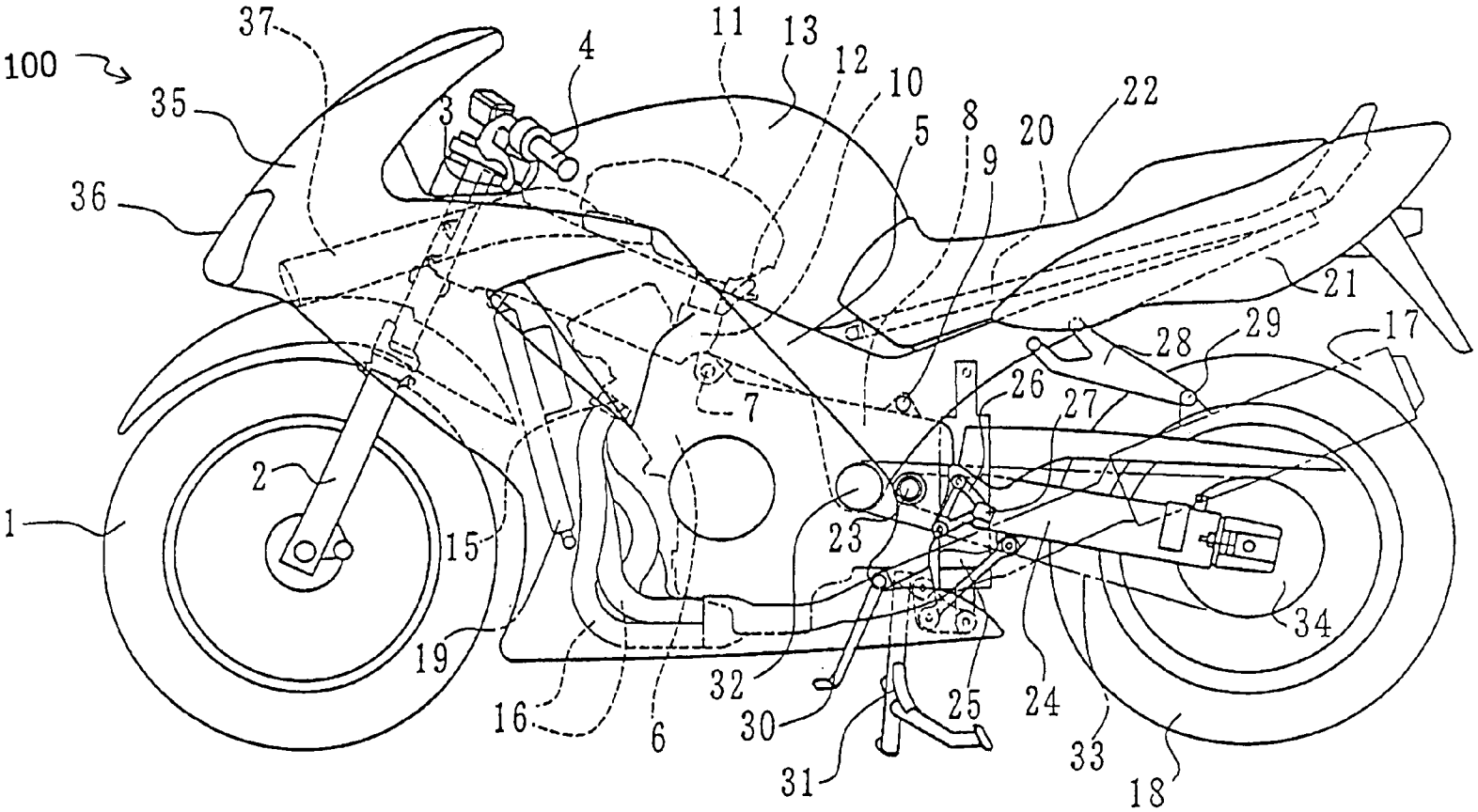
FIG. 1 is a side view of a motorcycle according to an embodiment of the present invention.

Referring to the drawings, an embodiment will be described below. FIG. 1 is a side view of a motorcycle 100 according to the present embodiment. Motorcycle 100 is provided having a front wheel 1, a front fork 2, a head pipe 3, a handle 4, and a main frame 5. The main frame 5 is an elongated square pipe formed of light weight alloy, that extends from the head pipe 3 and branches into left and right pipes which extend obliquely downward and rearward.

On the lower portion of the main frame 5, a parallel four-cylinder engine 6 is supported. The engine 6 is supported at a point 7 where the mid section of the main frame 5 and the upper end of the cylinder is connected. The engine 6 is also support at a point 9 where the rear end of the main frame 5 and the upper rear end of the mission case 8 of the engine 6 are connected.

Air is taken into an air-intake port 10 of the engine 6 below an air cleaner 11, which is an example of an air box, and which is supported by the main frame 5. Reference numeral 12 designates an injector. The air cleaner 11 is stored in a recess formed on the underside of the front bottom surface of a fuel tank 13 formed so as to project upward.

An exhaust pipe 16 extends forward from an exhaust port 15, passes downwardly of the engine 6, and then extends rearward. The exhaust pipe 16 is connected to a pair of left and right mufflers 17. The left and right mufflers 17 are disposed on both sides of a rear wheel 18. A radiator 19 is disposed forwardly of the engine 6.

A pair of left and right seat rails 20 are provided from the rear end of the main frame 5 obliquely upward toward the rear, a rear cowl 21 surrounds the seat rails 20, and a seat 22 is provided thereon.

At the vertical mid section of the rear end of the mission case 8 of the engine 6, the front ends of rear swing arms 24 are supported by a pivot shaft 23 so as to be capable of swinging in the vertical direction. The rear wheel 18 is supported at the rear ends of the rear swing arms 24.

The motorcycle 100 also includes a rear cushion 25, a step bracket 26, and a foldable main step 27. Pinion step holders 28 are provided so as to extend from the lower sides of the rear cowl 21 downward on left and right sides of the vehicle body. Pinion steps 29 are provided at the lower ends of the pinion step holders 28. The lower ends of the pinion step holders 28 also support mufflers 17. The motorcycle 100 has a side stand 30, a main stand 31, an output sprocket 32, a chain 33, and a driven sprocket 34. Furthermore, a front cowl 35 covers the front of the vehicle to left and right sides of the vehicle body.

As shown in FIG. 1, the front cowl 35 includes a lamp container 36 for a headlight or the like at the extremity of the front surface thereof. Ducts 37 are provided in the vicinity pf the lamp container 36 at a position slightly downward thereof on the left and right sides so as to open obliquely downward toward the front. The rear end portions of the ducts 37 extend inside the front cowl 35 obliquely upward toward the rear and open into the air cleaner 11.

Figure 2:
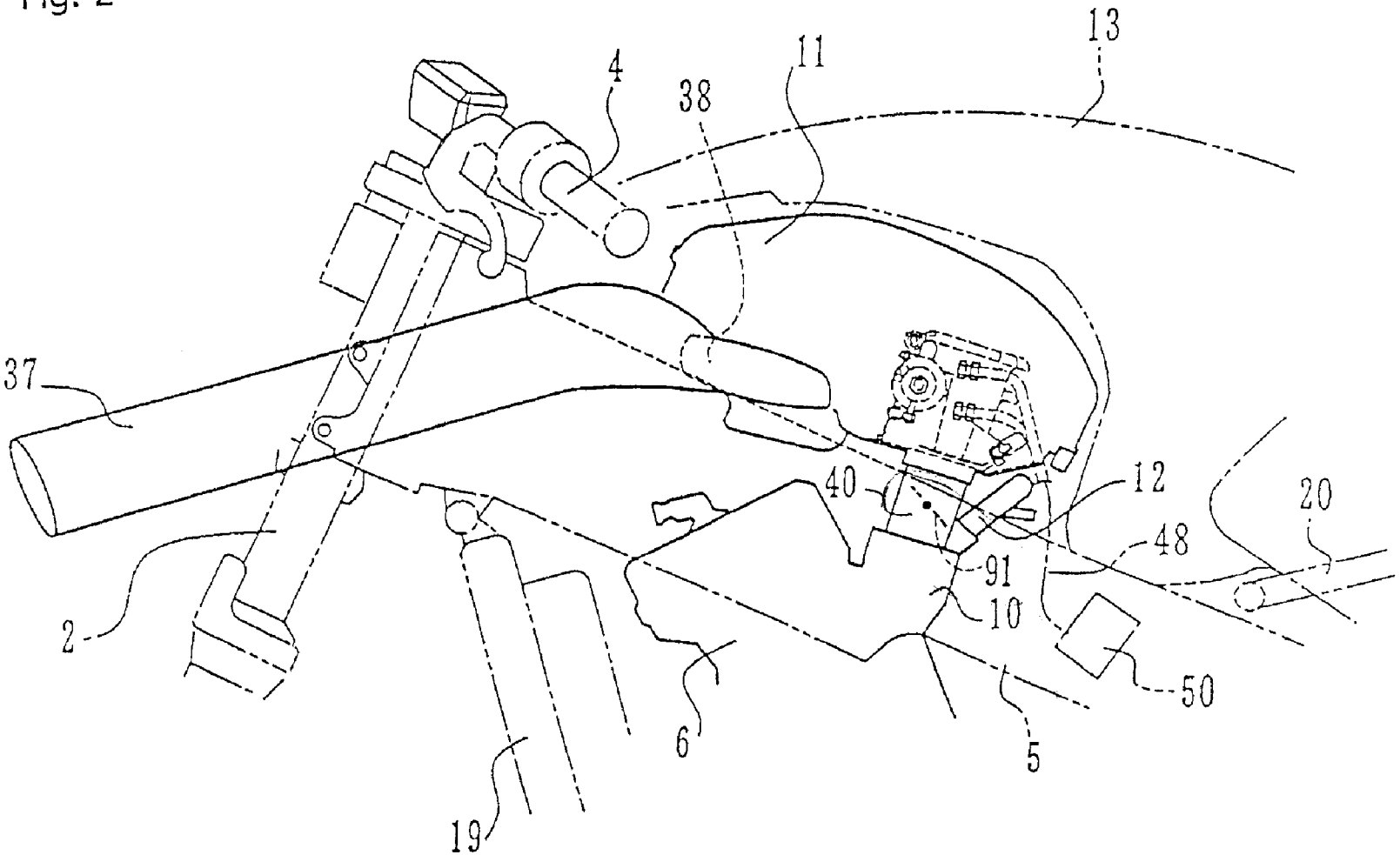
FIG. 2 is a side view of a principal portion of a vehicle body showing an air-intake structure mounted to an engine.

FIG. 2 shows the structure of an air-intake system. An exit 38 at the rear end of the duct 37 is connected to the lower front surface of the air cleaner 11.

A throttle body 40 extends downward from the rear portion of the air cleaner 11, and the lower end thereof is connected to the air-intake port 10 provided on the cylinder head of the engine 6. The throttle body 40 is an example of the main body which immediately precedes the engine cylinders and has its own throttle valve 91 therein.

Figure 3:
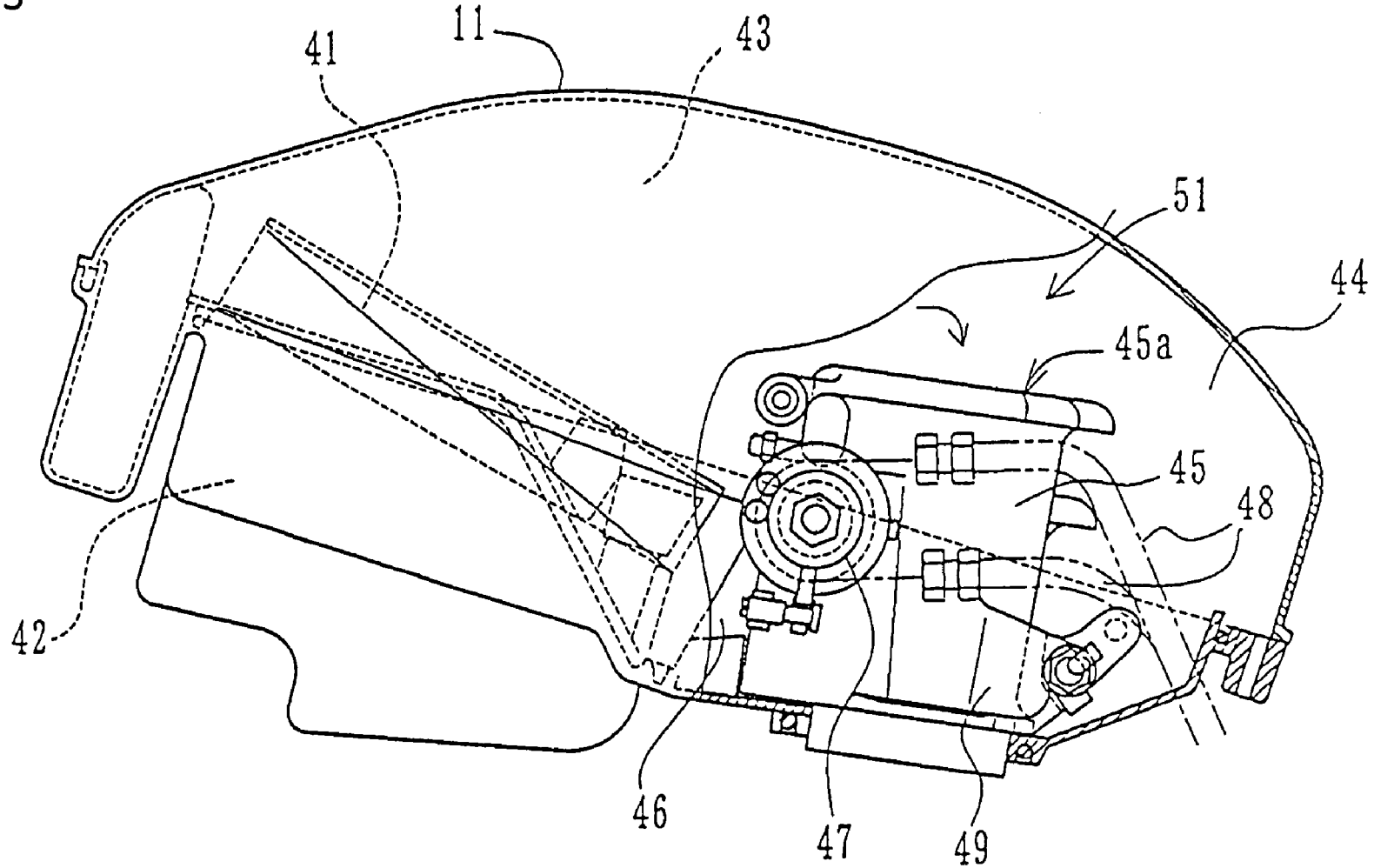
FIG. 3 is a drawing of an isolated air cleaner showing the actuation assembly mounted on the blocking body chamber.

FIG. 3 is an isolated side view of the air cleaner 11. The front half of the air cleaner 11 is divided into a lower dirty room 42 and an upper front clean room 43 via a filter element 41. The entire rear half constitutes a rear clean room 44.

A funnel pipe 45, which is an example of the intake air-introducing member, is disposed vertically within the rear clean room 44. The end 45*a* of the funnel pipe 45 on the upstream side of intake air is formed having a bellmouth-shape. The funnel pipe 45 has a substantially cylindrical shape, and provides an air-intake channel having a substantially circular cross section. The inner diameter thereof gradually increases toward the upstream end thereof, and hence it is almost entirely formed into an expanded portion. The funnel pipe 45 is formed separately from the main throttle body 40, as is funnel tube 53, described later. The structures of the funnel pipes 45, 53 are common, thus only funnel pipe 45 will be described.

Clean air is introduced from the duct 37 into the dirty room 42, and proceeds from the dirty room 42 through the filter element 41 to the front clean room 43. Clean air enters into the funnel pipe 45 of the rear clean room 44, and sucked from the throttle body 40 to the air-intake port 10.

A blocking body chamber 46 is provided upon the front side of the funnel pipe 45, and a blocking body 60, described later, provided therein is rotated by a pulley 47. Blocking body 60 is provided on the side surface of the funnel pipe to vary the cross-sectional area of the air-intake channel. The blocking body chamber 46 is an expanded portion located on the upstream side of the throttle valve provided in the main throttle body 40, where the air-intake channel is throttled by the blocking body.

The pulley 47 is rotated in both directions by a pair of wire cables 48, 48. One end of each of the wire cables 48, 48 is supported by a stay 49 on the side surface of the funnel pipe 45. The other end thereof penetrates through the rear wall of the air cleaner 11 and extends to the outside of the air cleaner 11, where it is connected to an actuator 50 (FIG. 2). The pulley 47 is rotated in both directions by the actuator 50. The actuator 50 is supported in the vicinity of the air cleaner 11 at a position rearwardly thereof so as to overlap the main frame 5 when viewed from the side, as shown in FIG. 2.

Figure 4:
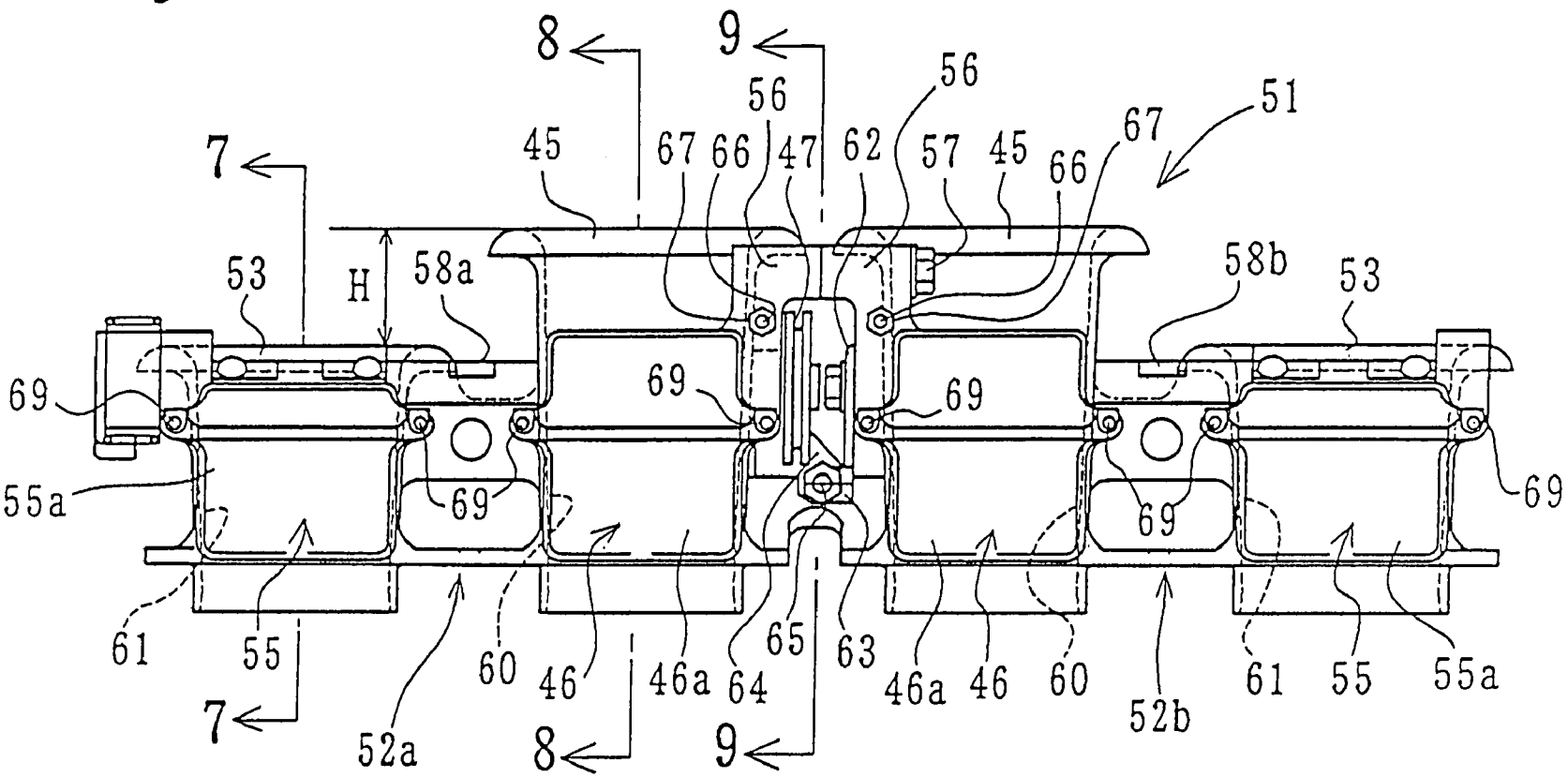
FIG. 4 is a front view of an intake-air introducing assembly according to the present invention showing the mechanisms which interconnects the left and right side support shafts.

FIG. 4 is a front view of an intake-air introducing assembly 51 in the air cleaner 11 shown from the front of the vehicle body. The intake-air introducing assembly 51 is divided into bases 52*a* and 52*b* on the left and the right at the widthwise midsection of the vehicle. Each base 52*a*, 52*b* is integrally formed with two types of funnel pipes formed of light-weight alloy or the like and having different heights. The two types of funnel pipes include the higher funnel pipe 45 positioned adjacent to the widthwise center of the vehicle, and the lower funnel pipe 53 positioned on the outer, or lateral, side thereof.

The upper ends of the funnel pipes 45, 53 are different in height by an amount H. The funnel pipes 45, 53 are provided with blocking body chambers 46, 55, respectively. The blocking body chambers 46 are formed to project slightly upward with respect to blocking body chambers 55. The upper parts of the adjacent blocking body chambers 46, 46 of the base 52*a* and the base 52*b* are formed with bosses 56, 56 projecting upwards, which are connected integrally with a bolt 57 from the side.

Between the adjacent blocking body chambers 46, 46, the pulley 47 is rotatably attached to the side surface of the blocking body chamber 46 on the side of the base 52*a*. A support shaft 58*a*, which is a center axis of the rotation of the pulley 47, extends through the blocking body chamber 46 and the blocking body chamber 55 of the base 52*a* widthwise of the vehicle, so that respective blocking bodies 60, 61 are rotated coaxially.

The side of base 52*b* has the same structure. However, on this side, the pulley 47 is not provided, and instead a rotary plate 62 is rotatably and integrally provided on the shaft end of a support shaft 58*b* on the side of the base 52*b*. A projecting strip 63 is formed at the lower end of the rotary plate 62 that extends toward the pulley 47.

The projecting strip 63 is adapted allow common rotation of the pulley 47 and the rotary plate 62 by being superimposed on, and connected by the adjustment screw 65 with, a projecting strip 64 that extends from the pulley 47 toward the rotary plate 62. Thus, the support shaft 58*a* on the side of the base 52*a* and the support shaft 58*b* on the side of the base 52*b* rotate synchronously.

The support shaft 58*b* has the same structure as the support shaft 58*a* except for the difference between the pulley 47 and the rotary plate 62. The structure of the blocking body chambers 46 and the blocking body chambers 55 is the same. A bolt 66 projects from the side of the blocking body chamber 46 for mounting the boss 56 to the side of the funnel 45 with a nut 67. Bolts 69, 69 are used to mount the blocking body chamber covers 46*a*, 55*a*, respectively of the blocking body chambers 46 and the blocking body chambers 55.

Figure 5:
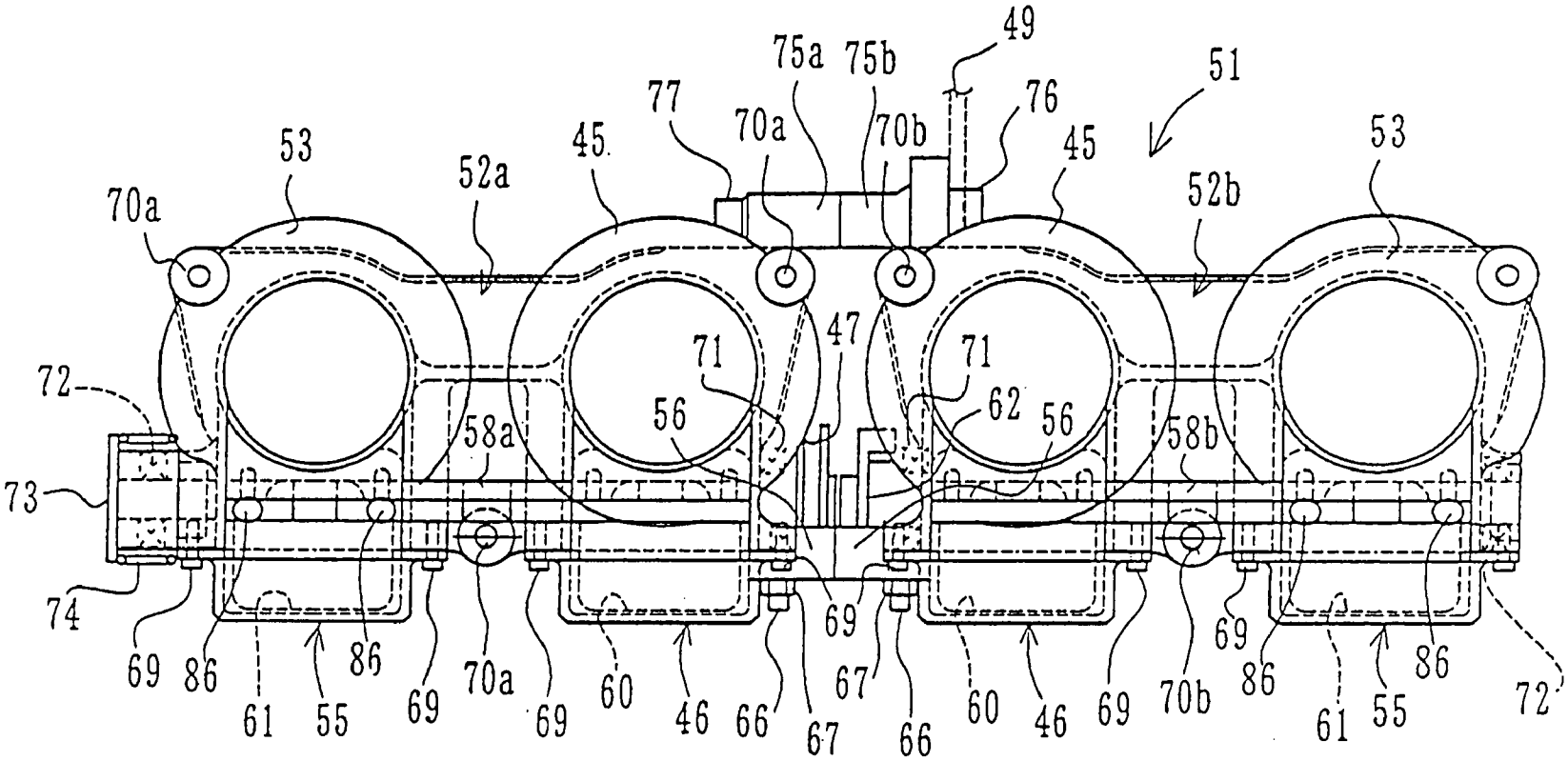
FIG. 5 is a plan view of the intake-air introducing assembly of FIG. 4.

FIG. 5 is a plan view of the intake-air introducing assembly 51, in which reference numerals 70*a*, 70*b* designate mounting holes for mounting the base 52*a* and the base 52*b* to the bottom of the air cleaner 11. The support shaft 58*a* is supported at both ends thereof by bearings 71, 72, and connected at the outer ends thereof to end plates 73. The end plates 73 are urged outward by springs 74.

The rear sides of the base 52*a* and the base 52*b* are provided with bosses 75*a*, 75*b* projecting from the tops of the adjacent blocking body chambers 46, 46 respectively, and are connected from the side by a bolt 76 and a nut 77. At this time, the cable stay 49 is secured to the boss 75*b* together with the bolt 76.

Figure 6:
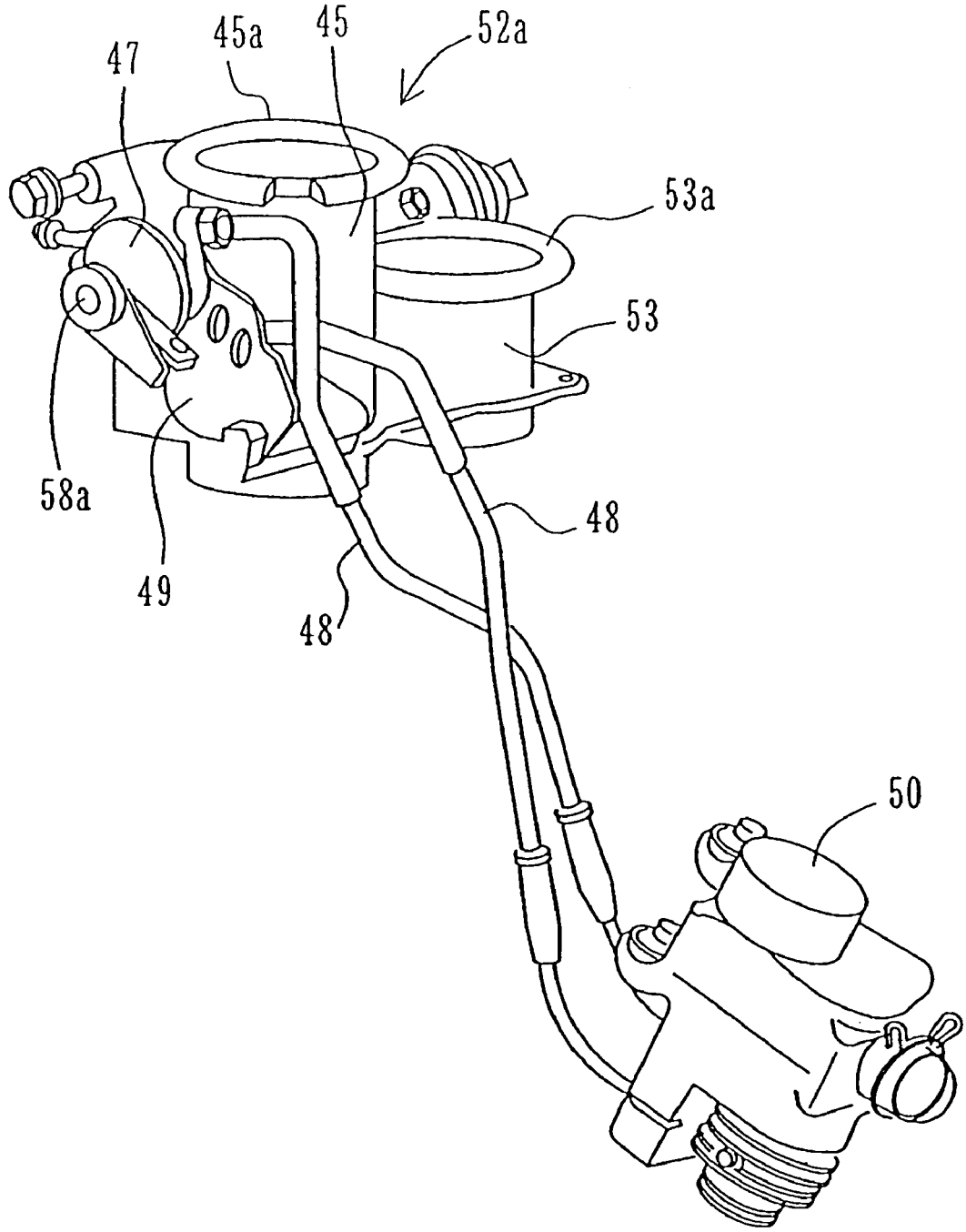
FIG. 6 is a perspective view of an isolated blocking body driving system.

FIG. 6 is a perspective view showing a driving system of the blocking body. The front ends of the cables 48 extend from the actuator 50 and are disposed outside the air cleaner 11. The front ends of the cables 48 are supported by a stay 49 provided on the side wall of the funnel pipe 45, and from there, the wire portions protrude and are connected to the pulley 47.

Figure 7:
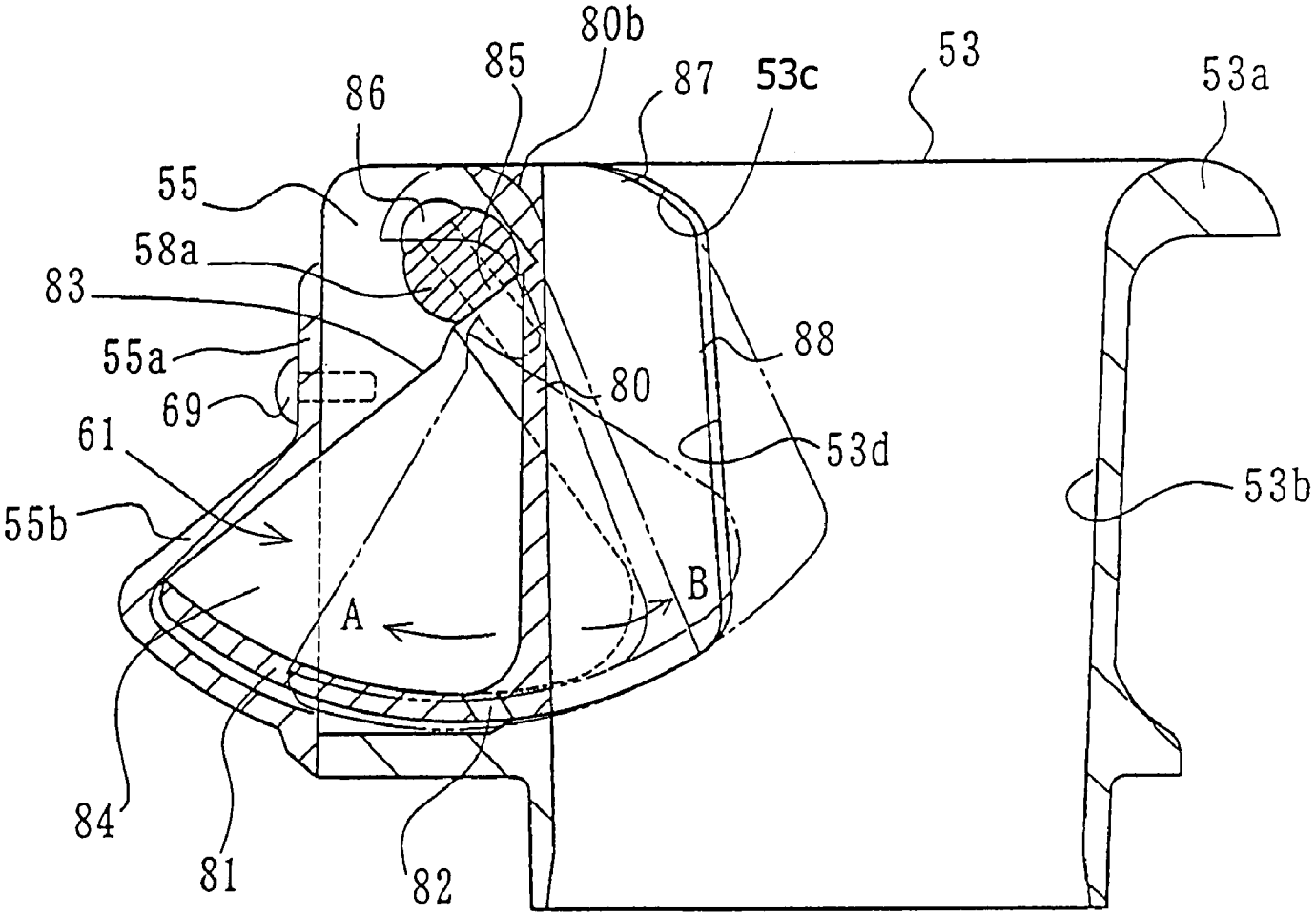
FIG. 7 is a cross-sectional view taken along the line 7—7 in FIG. 4 showing the blocking body disposed within the blocking body chamber of the short air intake funnel.

FIG. 7 is a cross-sectional view taken along the line 7—7 in FIG. 4, showing structures of the blocking body chamber 55 and the funnel pipe 53. The blocking body chamber 55 is formed so that the front wall is protruding forward, and is covered with the blocking body chamber cover 55*a*. The lower portion of the blocking body chamber cover 55*a* is formed into a tapered portion 55*b* protruding obliquely forward, and the lower portion of the blocking body 61, which rotates forward when unthrottled, is projected outward of the air-intake channel.

The upper end of the funnel tube 53 is formed into a bellmouth portion 53*a* spreading outward in a flange shape. The inner peripheral wall 53*b* defines an air-intake channel having a substantially circular cross-section. The inner peripheral wall 53*b* comprises continuous notches 53*c*, 53*d* that accommodate the blocking body 61, formed by cutting off part of the side surface thereof. The upper notch 53*c* reaches the upper end of the funnel pipe 53. The notch 53*d*, located downwardly of the upper notch 53*c*, extends substantially in parallel with the axis of the funnel pipe 53. The upper notch 53*c* is significantly shorter than the lower notch 53*d*.

The blocking body 61 is formed into a substantially triangular shape when viewed in the direction of the axis of the support shaft 58*a*, and the upper part, which corresponds to the apex portion, swings about the support shaft 58*a*. The support shaft 58*a* is located adjacent to the upper end of the funnel pipe 53. An inner wall surface 80 of the blocking body 61, which faces the air-intake channel of the funnel pipe 53, is formed into a concaved surface having the same curvature as that of the inner peripheral wall 53*b* of the funnel pipe 53. Therefore, when not throttled, as shown in the figure by a solid line, the inner wall surface 80 is flush with the inner peripheral surface 53*b* of the funnel pipe 53, which defines part of the side wall of the funnel pipe 53. A bellmouth cross-sectional portion 80*b* is also formed integrally with the upper end of the inner wall surface 80.

A lower portion 81 of the blocking body 61 is formed into an arcuate shape extending outward, and is formed with an air hole 82 adjacent to the inner wall surface 80. The outer extremity of the lower portion 81 and the upper end of the inner wall surface 80 are connected by a tapered surface 83. The tapered surface 83 serves as a stopper surface which comes into abutment with the tapered portion 55*b* when unthrottled. The outer side of the inner wall surface 80 is formed with a thinned recess 84.

The blocking body 61 is formed with a step 85 at the upper portion thereof, and the support shaft 58*a* is superimposed thereon. Support shaft 58*a* is connected to the blocking body 61 by a bolt 86, so that the blocking body 61 rotates together with the support shaft 58*a*. Part of the bellmouth cross-sectional portion 80*b* is notched for mounting the bolt 86. The blocking body chamber 55 is open at the top, and the support shaft 58*a* and the bolt 86 are exposed.

Along the circumference of the funnel pipe 53, the end of the blocking body 61 includes an upper cut surface 87 that is substantially arcuate in shape at the upper end portion thereof with respect to the centerline of the funnel pipe 53, and a lower cut surface 88 that is substantially parallel with the centerline on the lower side thereof. The upper cut surface 87 and the lower cut surface 88 of the blocking body 61 substantially coincide with the upper notch 53*c* and the lower notch 53*d* when the blocking body 61 is unthrottled.

The imaginary line in FIG. 7 represents the position of the blocking body 61 when throttled, and the inner wall surface 80 protrudes obliquely into the air-intake channel in the funnel pipe 53. In this situation, the lower end of the blocking body 61 protrudes more toward the center than the upper end of the blocking body 61 since the support shaft 58*a* serves as the fulcrum of the rotation. As a result, the cross-sectional area of the air-intake channel decreases. Since the fulcrum of the rotation is located on the upper portion of the blocking body 61, and the lower portion 81, which rotates by the largest extent, is located on the lower portion of the blocking body 61, the cross-sectional area of the air-intake channel varies continuously such that the throttled extent is largest on the lower side when the blocking body 61 is rotated.

Figure 8:
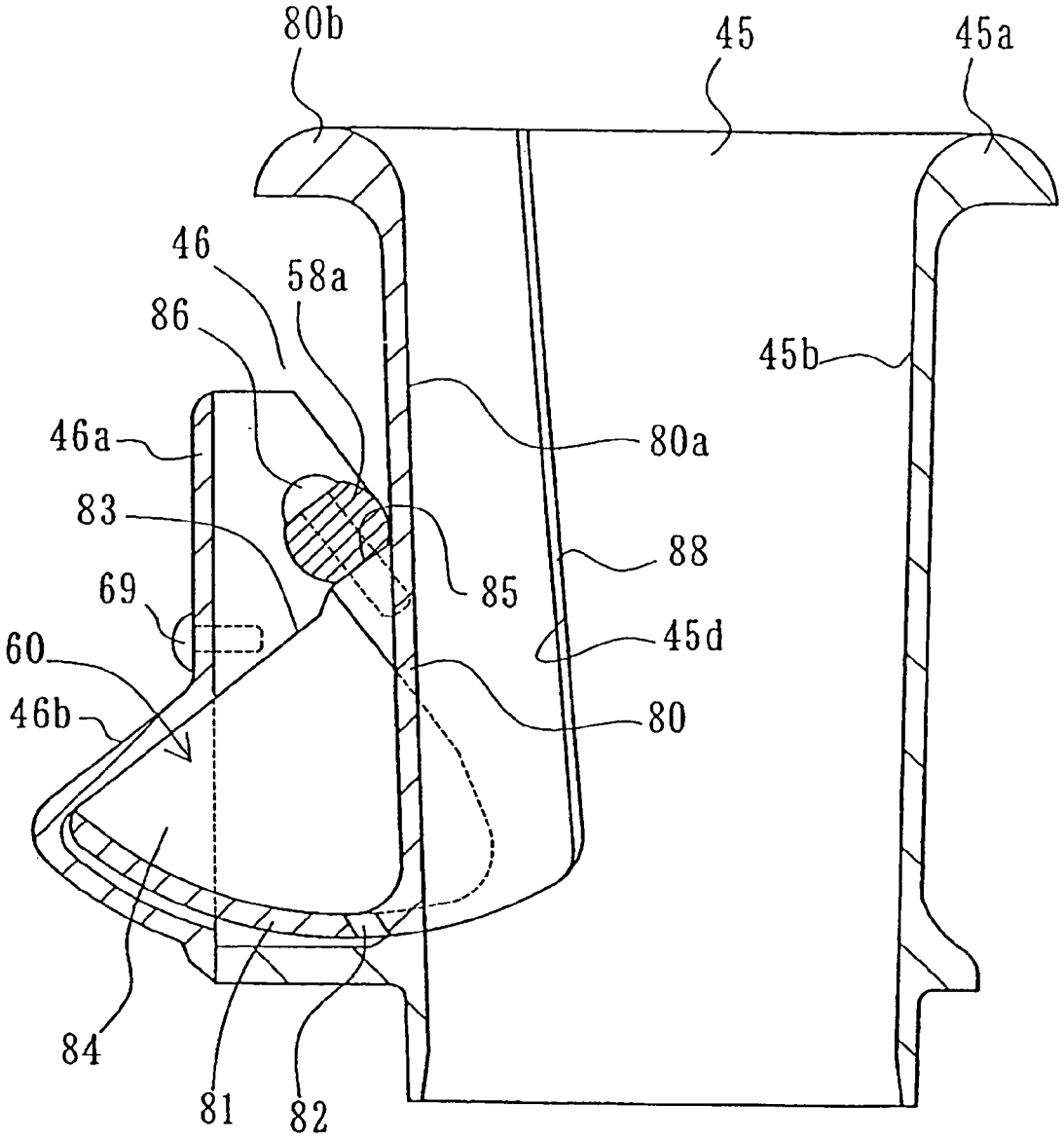
FIG. 8 is a cross-sectional view taken along the line 8—8 in FIG. 4 showing the blocking body disposed within the blocking body chamber of the tall air intake funnel.

FIG. 8 is a cross-sectional view taken along the line 8—8 in FIG. 4, showing the structures of the blocking body chamber 46 and the funnel pipe 45. The elements common to the blocking body chamber 55 and the funnel pipe 53 are represented by common reference numerals and the redundant description is omitted. The blocking body chamber 46 is formed by providing the front wall of the funnel pipe 45 with a protrusion that extends toward the front, and includes a blocking body chamber cover 46*a*, and a tapered portion 46*b*. The blocking body chamber 46 is also open on top.

The position of the support shaft 58*a* is at the mid-height section of the funnel pipe 45. Support shaft 58*a* is connected to the blocking body 60 along the side of lower portion 81 of the blocking body 60. The lower portion 81 of the blocking body 60 swings outwardly and inwardly of the funnel pipe 45 about the support shaft 58*a*. The support shaft 58*a* is secured to the blocking body 60 by the bolt 86. In other words, the fulcrum of the rotation is positioned on the upper side of the funnel pipe 45, and the side of the lower portion 81, which is moved by the largest extent, is positioned on the lower side of the funnel pipe 45, so that the lower portion 81 of the blocking body 60, which rotates forward when unthrottled, is moved outwardly of the air-intake channel.

The blocking body 60 is formed with a substantially triangular outline shape when viewed in the direction of the axis of the support shaft 58*a*. The upper portion of the blocking body 60, which corresponds to the apex portion, swings about the support shaft 58*a*. The blocking body 60 includes the inner wall surface 80, the lower portion 81, the air hole 82, the tapered surface 83, the thinned recess 84, and a shoulder 85 as described above with respect to funnel pipe 53. The inner wall surface 80 defines an extending portion 80*a* extending upwardly of the position of the support shaft 58*a*, reaches a bellmouth portion 45*a* of the funnel pipe 45 to define part of the side wall, and the bellmouth cross-sectional portion 80*b* is also formed integrally therewith.

The wall of the funnel pipe 45 on the side of the blocking body chamber 46 is formed with a notch 45*d*, and the notch 45*d* linearly extends in substantially parallel with the axis of the funnel pipe 45 upward in the drawing and reaches the bellmouth portion 45*a*. Along the circumference of the funnel pipe 45, the end 88 of the blocking body 60 is adapted to coincide substantially with the notch 45*d* when unthrottled. The inner peripheral surface 45*b* of the funnel pipe 45 defines an air intake channel.

In this arrangement, since the side wall 80 is extends until it reaches the opening at the upper end of the funnel pipe 45, even when the support shaft 58*a* is located at a low position with respect to the height of the funnel pipe 45, it is not necessary to form notches which may appear as concavity and convexity on the inner wall 45*b* of the funnel pipe 45 when unthrottled. In this way, the flow of intake air is smooth.

Figure 9:
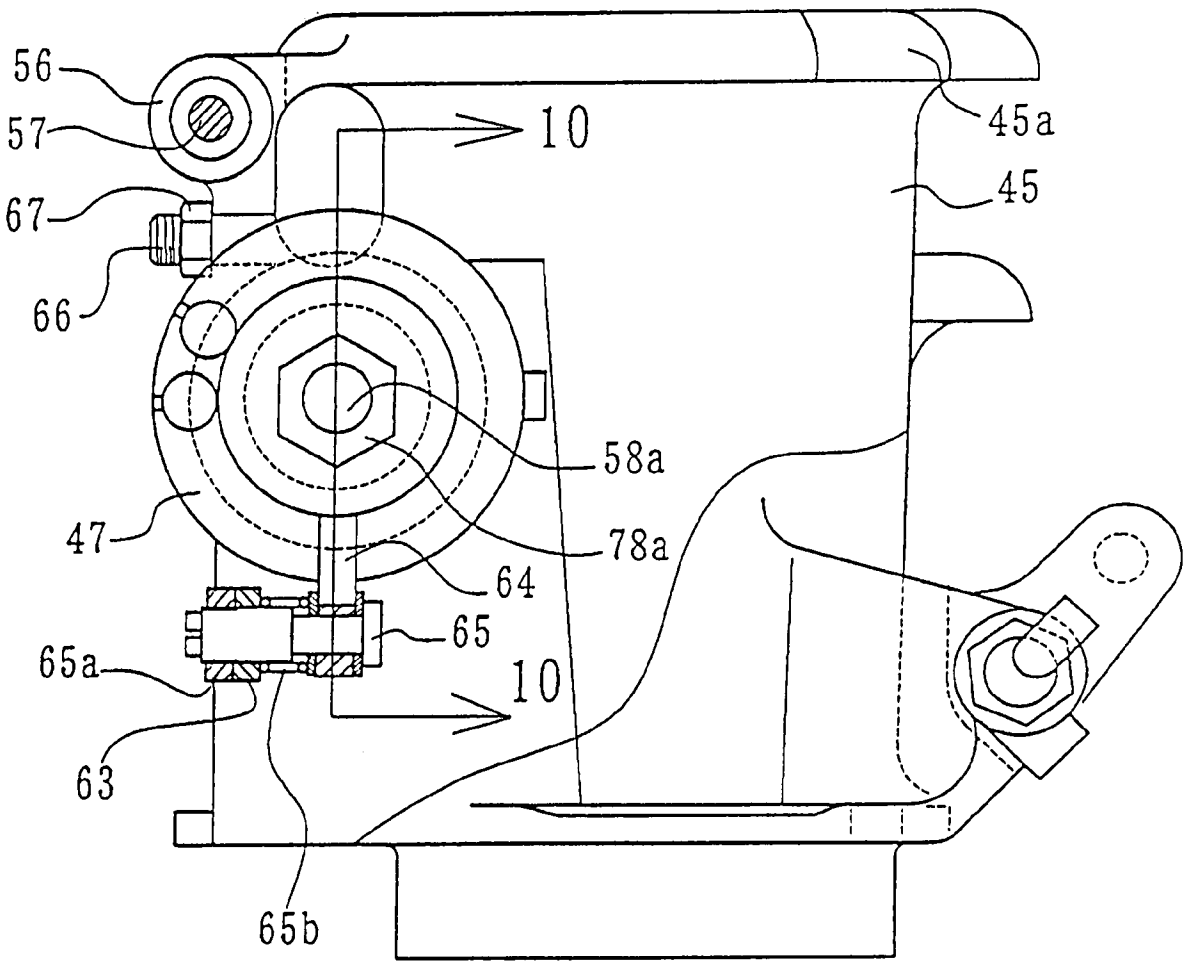
FIG. 9 is a cross-sectional view taken along the line 9—9 in FIG. 4 showing the pulley assembly which actuates the blocking bodies.

FIG. 9 is a cross sectional view taken along the line 9—9 in FIG. 4. The lower portion of the projecting strip 64 extending downward from the pulley 47 engages an adjusting screw 65. The adjusting screw 65 penetrates the projecting strip 63, and engages a nut 65*a*. An adjust spring 65*b* is interposed between the projecting strip 63 and the projecting strip 64, and the distance between the projecting strip 63 and the projecting strip 64 can be adjusted by the nut 65*a*.

Figure 10:
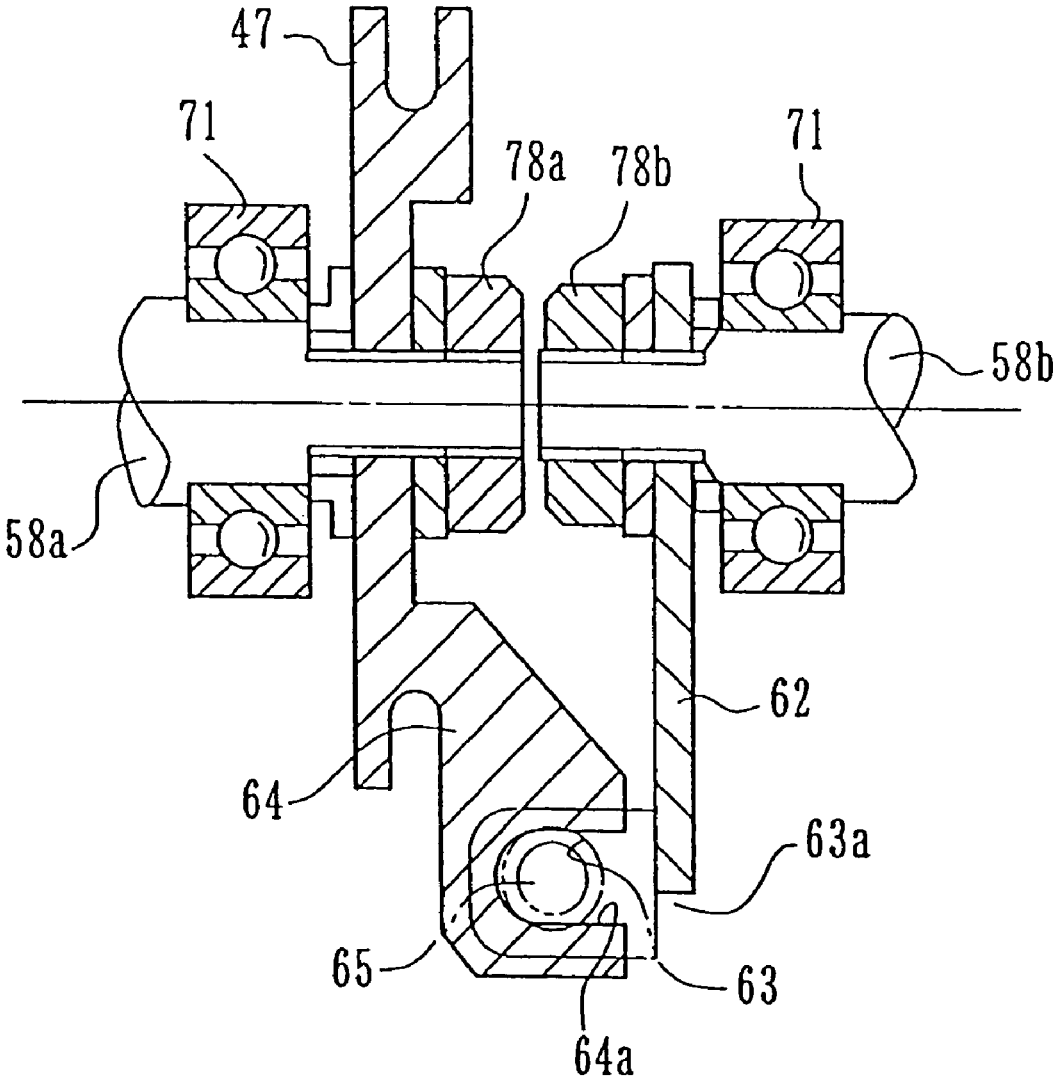
FIG. 10 is a cross-sectional view taken along the line 10—10 in FIG. 9 showing the interconnections between the left and right side support shafts.

FIG. 10 is a cross-sectional view taken along the line 10—10 in FIG. 9. The pulley 47 is secured to a threaded portion formed at the end of the support shaft 58*a* with a nut 78*a*. The projecting strip 64 integrally formed with the pulley 47 is formed with a U-shaped groove 64*a* at the lower end thereof, which engages the outer peripheral portion of the adjusting screw 65.

On the other hand, the rotary plate 62 is also secured to a threaded portion formed at the end of the support shaft 58*b* with a nut 78*b*. The support shaft 58*a* and the support shaft 58*b* are coaxially disposed. The projecting strip 63 formed at the lower end of the rotary plate 62 is formed with a through hole 63*a*, through which the adjusting screw 65 is passed. When the projecting strip 63 and the projecting strip 64 are superimposed by the U-shaped groove 64*a*, the displacement with respect to the thorough hole 63*a* can be adjusted.

The operation of the present embodiment will now be described. Although the description will be made mainly with respect to the base 52*a*, it will be understood that the base 52*b* also operates in the same manner. Referring now to FIG. 7 and FIG. 8, when the blocking body 60 and the blocking body 61 rotate in the direction indicated by an arrow A when unthrottled, the air-intake channel is brought into the fully opened state. On the other hand, when it is rotated in the direction indicated by an arrow B, the blocking body 60 and the blocking body 61 protrude into the air-intake channel, thereby throttling the cross-sectional area of the air-intake channel.

Each of the blocking bodies 60, 61 is substantially triangle when viewed in the direction of the axis of the support shaft 58*a*. When the upper portion of the blocking bodies 60, 61, which corresponds to the apex thereof, swings about the support shaft 58*a*, the blocking bodies 60, 61 act to throttle such that the cross-sectional area of the air-intake channel is reduced. Therefore, the inner wall surface 80, which projects into the air-intake channel when throttled, forms a continuous inclined surface varying so as to protrude more into the air-intake channel on the lower side. The flow of intake air flows more smoothly when compared with a conventional slide-type valve wherein the blocking body slides in the radial direction of the funnel pipe, causing turbulence in the flow of air.

Also, since the blocking bodies 60, 61 are disposed on the funnel pipes 45, 53, and since the funnel pipes 45, 53 are intake air-introducing members located at a distance from the engine, space for arranging the blocking bodies 60, 61 is easily secured. In addition, since the blocking bodies 60, 61 are disposed at the positions distant from the engine, members such as the cables 48, 48 and the like extending from the actuator 50 for driving the same can be prevented from interfering with the engine, and hence they are easily arranged.

In addition, since the funnel pipes 45, 53 are located apart from the engine, by positioning the support shaft 58*a* upstream of the funnel pipes 45, 53, spacing of the support shaft with respect to the engine is easily secured. In this case, when the support shaft 58*a* is installed in the vicinity of the ends of the upper openings of the funnel pipes 45, 53, the space with respect to the engine is secured even more easily.

Also, since the funnel pipes 45 and 53 are disposed in the air cleaner 11, the blocking bodies 60, 61 are also arranged in the air cleaner 11. Therefore, the operating sound produced by the movable blocking bodies 60, 61 is reduced. In addition, since the pulley 47, the support shaft 58*a*, or the like, which are movable members of the blocking bodies 60, 61 are also accommodated within the air cleaner 11, they are protected from splashing mud.

Furthermore, when the blocking body 60 is unthrottled, the inner wall surface 80 facing the air-intake channel is formed into a curved surface so as to be flush with the inner peripheral wall 45*b* of the funnel pipe 45. The lower portion 81 is positioned so as to be retracted out of the air-intake channel. Becuase the blocking body 60 is positioned outside the air-intake channel and does not project into the air-intake channel, intake air flows smoothly along the wall surface of the air-intake channel. This condition is the same for the blocking body 61.

Since the blocking bodies 60, 61 form part of the ends of the openings of the funnel pipes 43, 53, it is not necessary to form recesses facing the air-intake channel within the movable ranges of the blocking bodies 60, 61 even when these bodies are in the unthrottled position. Therefore, the air-intake channel is smooth. Consequently, the flow of intake air is not easily disturbed when throttling using the blocking bodies 60, 61.

In addition, since the height of the support shaft 58*a* is the same for the funnel pipes 45 and 53, which have different heights, the blocking bodies 60, 61 can be driven by the common support shaft 58*a*. Hence a reduction in the number of components is achieved. In addition, since the support shaft 58*a* is disposed outside the funnel pipes 45, 53, or in other words, since the support shaft 58*a* is disposed outside the air-intake channel, it does not project into the air-intake channel, and consequently, the flow of intake air may be prevented from being easily disturbed.

The present invention is not limited to the one described above. For example the intake air-introducing member is not limited to the funnel pipe, and may be any member as long as it defines the air-intake channel. It may either be formed integrally with the throttle body or separately therefrom. Furthermore, the expanded portion is not necessarily required to be mounted on the separate intake air-introducing member. In addition, the height of the funnel, the position and the shape of the blocking body, and the height of the support shaft may be combined as needed, and the combinations shown below are conceivable.

TABLE 1

| No. | Height of funnel | position & shape of blocking body | height of blocking body shaft |
|---|---|---|---|
| 1 | uneven (for example, low at both ends and high on the inner portion | FIG. 7, 8, depending on the height of the funnel | same |
| 2 | same as 1 | FIG. 7, 8, depending on the height of the funnel | same |
| 3 | same as 1 | FIG. 8 | use link or the like because they are not the same |
| 4 | high | FIG. 7 | same |
| 5 | same as 4 | FIG. 8 | same |
| 6 | low | FIG. 7 | same |

Note: Figure Nos. shown in the column of "position and shape of blocking body" indicate that the blocking bodies are to be formed into the shape and to be positioned at the position as shown in those drawings, and when a plurality of numbers of the drawings are shown, either one may be selected arbitrarily.

Although the present invention has been described herein with respect to an illustrative embodiment, the foregoing description is intended to be illustrative, and not restrictive. Those skilled in the art will realize that many modifications of the embodiment could be made which would be operable. All such modifications which are within the scope of the claims are intended to be within the scope and spirit of the present invention.

We claim:

1. An intake air control apparatus for use with a vehicle engine, the intake air control apparatus comprising:

an intake air routing assembly, comprising:

an air-introducing member having an air-intake channel formed therein and having an expanded portion which defines part of the air-intake channel; and a preliminary throttle valve for adjustably regulating the amount of intake air flowing through the air-intake channel, wherein the preliminary throttle valve comprises an adjustable blocking body for varying the cross-sectional area of the air-intake channel;

wherein the blocking body is disposed in said expanded portion of said air-introducing member, wherein the blocking body is supported on a support shaft so as to be pivotable about an axis perpendicular to a direction of air flow within the air-intake channel, and the support shaft is disposed on the upstream side of said blocking body, and wherein a main throttle body is disposed downstream relative to the air introducing member, the main throttle body comprising a main throttle valve which permits adjustment of air flow within the main throttle body.

2. The intake air control apparatus for a vehicle according to claim 1, wherein the intake air control apparatus is separate from the main throttle body.

3. The intake air control apparatus for a vehicle according to claim 1, wherein the intake air control apparatus further comprises an air cleaner housing, wherein the blocking body is disposed in the cleaner housing, and wherein the air-intake side of said intake air-introducing member opens within the cleaner housing.

4. The intake air control apparatus for a vehicle according to claim 1, wherein the intake air control apparatus comprises an actuator, and wherein said blocking body is driven by the actuator.

5. The intake air control apparatus for a vehicle according to claim 1, wherein the support shaft is installed proximate an inlet opening of said intake air-introducing member.

6. The intake air control apparatus for a vehicle according to claim 1, wherein the support shaft is installed on the air-introducing member, outside of the air-intake channel.

7. In a vehicle of the type having an engine with a main throttle body having a main throttle valve, the improvement comprising an air-intake assembly comprising an intake air control apparatus, an intake air-introducing member, and a blocking body, wherein the intake air control apparatus is in communication with said main throttle body;

the intake air-introducing member forms part of an air-intake channel of the intake air control apparatus, wherein the air-intake channel is of substantially round shape in cross section;

the intake air blocking body provides for varying the cross-sectional area of said air-intake channel and defines part of the inner peripheral wall of said intake air-introducing member;

wherein the inner peripheral surface of the intake air blocking body that faces said intake air-introducing member is formed along said air-intake channel, the blocking body is supported on a support shaft so as to be pivotable about an axis perpendicular to a direction of air flow within the air-intake channel, and the support shaft is disposed on the upstream side of said blocking body, and a main throttle body is disposed downstream relative to the air introducing member, the main throttle body comprising a main throttle valve which permits adjustment of air flow within the main throttle body.

8. The air-intake assembly for a vehicle according to claim 7, wherein said intake air blocking body defines the end of the opening of said intake air-introducing member.

9. The air-intake assembly for a vehicle according to claim 7, wherein said support shaft is installed proximate an intake opening of said intake air-introducing member.

10. The air-intake assembly for a vehicle according to claim 7, wherein said intake air blocking body is positioned outside said air-intake channel when said air-intake channel is unthrottled.

11. In a vehicle of the type having an engine with a main throttle body having a main throttle valve, the improvement comprising an intake air routing assembly, comprising:

an air-introducing member having an air-intake channel formed therein, the air-intake channel extending within the air intake apparatus to supply air to the engine, the air-intake member comprising a funnel pipe, an upper throttle valve attached to the funnel pipe, and a lower throttle valve disposed downstream relative to the funnel pipe;

the funnel pipe disposed at an upper end of the air channel so as to lie upstream of the main throttle valve, wherein the upstream direction opposes the direction of air flow through the air channel, and wherein the upper throttle valve is supported on a support shaft so as to be pivotable about an axis perpendicular to a direction of air flow within the air-intake channel, and the support shaft is disposed on the upstream side of said upper throttle valve;

the upper throttle valve disposed within the funnel pipe such that when the upper throttle valve is idle, the air channel is substantially unobstructed, and such that when the upper throttle valve is actuated, the air channel is partially obstructed so as to provide a generally non-turbulent air flow therethrough.

12. The air intake apparatus of claim 11, wherein the funnel pipe comprises a generally cylindrical body having a circular cross section and having an open upper end which is outwardly flared, the upper throttle valve comprises a blocking body and a support shaft, wherein the blocking body defines a portion of a sidewall of the funnel pipe.

13. The air intake apparatus of claim 12, wherein the blocking body has a substantially triangular outline shape, with the apex of the triangle secured to the support shaft, and wherein the base of the triangle is disposed below the support shaft.

14. The air intake apparatus of claim 12, wherein:

the blocking body is aligned with the funnel pipe when the upper throttle valve is idle, such that the interior of the flannel pipe is generally smooth and uniform in diameter;

and wherein a lower portion of the blocking body extends into the air-intake channel of the flannel pipe when the upper throttle valve is actuated, such that the air-intake channel is provided with a restriction which angles inward in the downstream direction, wherein the downstream direction coincides with the direction of air flow through the air channel.

15. The air intake apparatus of claim 11, wherein the upper throttle valve is positioned at a distance from the engine.

16. The air intake apparatus of claim 11, wherein the air intake apparatus comprises an air cleaner housing, and wherein the funnel pipe is disposed in and opens upward within the air cleaner housing such that the upper throttle valve is disposed within the air cleaner housing.

17. An intake air control apparatus for use with a vehicle engine, the intake air control apparatus comprising:

an intake air routing assembly, comprising:

an air-introducing member having an air-intake channel formed therein and having an expanded portion which defines part of the air-intake channel; and a preliminary throttle valve for adjustably regulating the amount of intake air flowing through the air-intake channel, wherein the preliminary throttle valve comprises an adjustable blocking body for varying the cross-sectional area of the air-intake channel;

wherein the blocking body is disposed in said expanded portion of said air-introducing member, and wherein the intake air control apparatus further comprises an air cleaner housing, the blocking body is disposed in the cleaner housing, and the air-intake side of said intake air-introducing member opens within the cleaner housing.

18. In a vehicle of the type having an engine with a main throttle body having a main throttle valve, the improvement comprising an intake air routing assembly, comprising:

an air-introducing member having an air-intake channel formed therein, the air-intake channel extending within the air intake apparatus to supply air to the engine, the air-intake member comprising a funnel pipe, an upper throttle valve attached to the flannel pipe, and a lower throttle valve;

the funnel pipe disposed at an upper end of the air channel so as to lie upstream of the main throttle valve, wherein the upstream direction opposes the direction of air flow through the air channel; and the upper throttle valve disposed within the flannel pipe such that when the upper throttle valve is idle, the air channel is substantially unobstructed, and such that when the upper throttle valve is actuated, the air channel is partially obstructed so as to provide a generally non-turbulent air flow therethrough, wherein the funnel pipe comprises a generally cylindrical body having a circular cross section and having an open upper end which is outwardly flared;

the upper throttle valve comprises a blocking body and a support shaft, wherein the blocking body defines a portion of a sidewall of the funnel pipe; and the blocking body has a substantially triangular outline shape, with the apex of the triangle secured to the support shaft, and wherein the base of the triangle is disposed below the support shaft.

19. In a vehicle of the type having an engine with a main throttle body having a main throttle valve, the improvement comprising an intake air routing assembly, comprising:

an air-introducing member having an air-intake channel formed therein, the air-intake channel extending within the air intake apparatus to supply air to the engine, the air-intake member comprising a funnel pipe, an upper throttle valve attached to the funnel pipe, and a lower throttle valve;

the funnel pipe disposed at an upper end of the air channel so as to lie upstream of the main throttle valve, wherein the upstream direction opposes the direction of air flow through the air channel;

the upper throttle valve disposed within the funnel pipe such that when the upper throttle valve is idle, the air channel is substantially unobstructed, and such that when the upper throttle valve is actuated, the air channel is partially obstructed so as to provide a generally non-turbulent air flow therethrough, and wherein the intake air intake routing assembly comprises an air cleaner housing, and wherein the funnel pipe is disposed in and opens upward within the air cleaner housing such that the upper throttle valve is disposed within the air cleaner housing.

* * * * *